US006981663B2

(12) United States Patent
Fukutomi

(10) Patent No.: US 6,981,663 B2
(45) Date of Patent: Jan. 3, 2006

(54) FUEL INJECTION VALVE

(75) Inventor: Norihisa Fukutomi, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/826,269

(22) Filed: Apr. 19, 2004

(65) Prior Publication Data

US 2005/0098665 A1 May 12, 2005

(30) Foreign Application Priority Data

Nov. 7, 2003 (JP) ..... P2003-378692

(51) Int. Cl.
*B05B 1/30* (2006.01)

(52) U.S. Cl. ..... 239/585.5; 239/585.1

(58) Field of Classification Search .. 239/585.1–585.5, 239/900; 251/129.15, 129.21
See application file for complete search history.

(56) References Cited

U.S. PATENT DOCUMENTS

| | | | | |
|---|---|---|---|---|
| 4,007,880 | A * | 2/1977 | Hans et al. | 239/585.5 |
| 5,190,221 | A * | 3/1993 | Reiter | 239/463 |
| 6,032,879 | A * | 3/2000 | Hamada et al. | 239/585.1 |
| 6,168,098 | B1 | 1/2001 | Brinn, Jr. | |
| 6,402,061 | B1 | 6/2002 | Fukutomi et al. | |

FOREIGN PATENT DOCUMENTS

| | | |
|---|---|---|
| JP | 59-015667 A | 1/1984 |

* cited by examiner

*Primary Examiner*—Christopher Kim
(74) *Attorney, Agent, or Firm*—Sughrue Mion, PLLC

(57) ABSTRACT

A moving iron core that reciprocates in axial direction in response to a fuel injection signal is provided with a radial recess of a predetermined width and a predetermined depth on the outer circumference at a position facing a magnetic characteristic change portion produced in a yoke due to heat generated when a sleeve and the yoke are welded together. As a result, it is possible to suppress the variation in injection quantity characteristic of the products caused by the magnetic characteristic change portion of the yoke due to the heat generated at the time of welding the sleeve and the yoke together.

2 Claims, 9 Drawing Sheets

FUEL INJECTION VALVE

BACKGROUND OF THE INVENTION

1. Field of the Invention

The present invention relates to a fuel injection valve mainly used in an engine for a vehicle.

2. Description of the Related Art

FIG. 6 is a vertical section showing the whole construction of a conventional fuel injection valve disclosed in, for example, the Japanese Patent Publication (unexamined) No. 2002-3831.

FIG. 7 is a partial enlarged view for explaining the construction of an essential part (a magnetic path portion) of the fuel injection valve shown in FIG. 6. Hatching that indicates a section is omitted in FIG. 7.

When a microcomputer of the engine sends an operation signal to a drive circuit (not shown in the drawings) of the fuel injection valve, an electric current flows through a coil 13, whereby magnetic fluxes indicated by lines of magnetic force 100 are generated in a magnetic loop formed of a stationary iron core 11, a moving iron core 22, a yoke 16, and a housing 12. Consequently, the moving iron core 22 is attracted toward the stationary iron core 11 by electromagnetic attraction stronger than spring force of a compression spring 14.

As the moving iron core 22 is attracted toward the stationary iron core 11, a valve element 21 integrated with the moving iron core also moves toward the stationary iron core 11, thus fuel injection into the engine being carried out.

In FIG. 6 or FIG. 7, reference numeral 17 designates a sleeve made of non-magnetic metal acting as a connecting member for connecting the yoke 16 and the stationary iron core 11.

This sleeve 17 is composed of a cylindrical part in which the stationary iron core 11 is fitted, and a ring part being a ring-shaped protrusion formed on the outer circumference of an end of the yoke 16 side of this cylindrical part. FIG. 7 clearly shows that the sleeve 17 is L-shaped in cross-section.

The ring part of the sleeve 17 is welded to the yoke 16 with the ring part being in contact with the yoke 16, and the cylindrical part of the sleeve 17 is welded to the stationary iron core 11 fitted in the cylindrical part.

Therefore, the stationary iron core 11 and the yoke 16 are fixed through the sleeve 17 in their positional relation.

Numeral 17*a* indicates a portion where the ring part of the sleeve 17 and the yoke 16 are welded together, and numeral 17*b* indicates a portion where the cylindrical part of the sleeve 17 and the stationary iron core 11 are welded together.

As described above, in the conventional fuel injection valve, the sleeve 17 made of non-magnetic metal is disposed between the yoke 16 and the stationary iron core 11 in order to reduce magnetic leakage between the stationary iron core 11 and the yoke 16 to a minimum. The yoke 16 and the sleeve 17 as well as the stationary iron core 11 and the sleeve 17 are joined together by welding in order to seal fuel in.

In particular, it is necessary that the valve element of the fuel injection valve for in-cylinder injection (i.e., fuel injection valve for a vehicle) responds at a high speed, and therefore it is required to minimize eddy current generated in the sleeve 17.

In such a fuel injection valve, a thickness t of the sleeve 17 is reduced to the minimum to minimize generation of eddy current.

In the conventional fuel injection valve of above construction, in the case where the sleeve 17 is thin, the welded portion 17*a* where the sleeve 17 and the yoke 16 are welded together is located near a magnetic path (i.e., path of the magnetic line of force 100) of the yoke 16. Therefore the portion where temperature rises due to welding spreads partly to the magnetic path of the yoke, and this portion (i.e., inside of a semi-circle indicated by the broken lines in FIG. 7) becomes a portion 16*a* of which magnetic characteristic is changed (hereinafter referred to as "magnetic characteristic change portion") and in which magnetic flux density is decreased.

Electromagnetic stainless steel mainly used as a material for the yoke 16 in fuel injection valve tends to exhibit a sharp decrease in magnetic flux density when the temperature comes up to be not lower than 900° C. (for example, the magnetic flux density being 1.10 T at 900° C. comes to decrease to 1.02 T at 950° C.) as shown in FIG. 8, whereby the electromagnetic attraction generated in the moving iron core 22 also decreases.

In the case where the fuel injection valves are mass-produced, the magnetic characteristic in the magnetic characteristic changed portion varies depending on variation in welding temperature and welding position, which eventually results in variation in electromagnetic attraction generated in the moving iron core also varies.

Hence a problem exists in that injection quantity characteristics of the produced fuel injection valves vary largely between one product and another.

FIG. 9 is a graphic diagram showing variation in injection quantity characteristic of the conventional fuel injection valves. In the drawing, the axis of abscissas indicates a drive pulse width (msec) of an injection signal impressed on the fuel injection valve, and the axis of ordinates indicates a fuel injection quantity ($mm^3$) per injection.

As shown in FIG. 9, the variation in injection quantity characteristics of the conventional fuel injection valves ranges approximately 10% between the uppermost and lowermost injection quantities.

SUMMARY OF THE INVENTION

The present invention was made to solve the above-discussed problem and has an object of providing a fuel injection valve for a vehicle capable of suppressing variation in injection quantity characteristic by individual products due to magnetic characteristic changed portion produced by heat generated at the time of welding the sleeve and the yoke together.

A fuel injection valve according to the invention includes: a valve section consisting of a cylindrical moving iron core that reciprocates in axial direction in response to fuel injection signal, a valve element integrated with the mentioned moving iron core at one end and provided with a valve seat at the other end, and a plate provided with orifices that are opened and closed as the mentioned valve seat comes in contact with the orifices and parts therefrom; and a solenoid section consisting of a cylindrical stationary iron core disposed facing the mentioned moving iron core in axial direction, a cylindrical yoke disposed on the outer circumference of the mentioned moving iron core, a non-magnetic metal sleeve where the mentioned stationary iron core and the mentioned yoke are joined into one body by welding, a housing forming a magnetic loop with the mentioned stationary iron core, moving iron core and yoke, a coil that is disposed on the outer circumference of the mentioned stationary iron core and gives axial electromagnetic attraction to the mentioned moving iron core, and a compression spring to urge spring force that moves the mentioned valve element toward the mentioned plate.

Furthermore, the mentioned moving iron core of the fuel injection valve according to the invention is provided with a radial recess of a predetermined width and a predetermined depth on the outer circumference thereof at a position facing a magnetic characteristic change portion produced in the mentioned yoke due to heat generated when the mentioned sleeve and the mentioned yoke are welded together.

In the mentioned fuel injection valve according to the invention, since the moving iron core is provided with a radial recess having a predetermined width and a predetermined depth on the outer circumference thereof at the position facing the magnetic characteristic change portion produced in the mentioned yoke due to heat generated at the time of welding the mentioned sleeve and yoke together, magnetic fluxes passing through the moving iron core detour and flow through underside of the recess (i.e., on the side where the stationary iron core is not disposed).

This makes it possible to reduce number of magnetic fluxes passing through the magnetic characteristic change portion of the yoke and prevent the influence of the variation in magnetic characteristic, and it is possible to suppress the variation in injection quantity characteristic of the products caused by the magnetic characteristic change portion due to the heat generated at the time of welding the sleeve and the yoke together.

The foregoing and other objects, features, aspects and advantages of the present invention will become more apparent from the following detailed description of the present invention when taken in conjunction with the accompanying drawings.

DETAILED DESCRIPTION OF THE INVENTION

Embodiment 1

Figure 1:
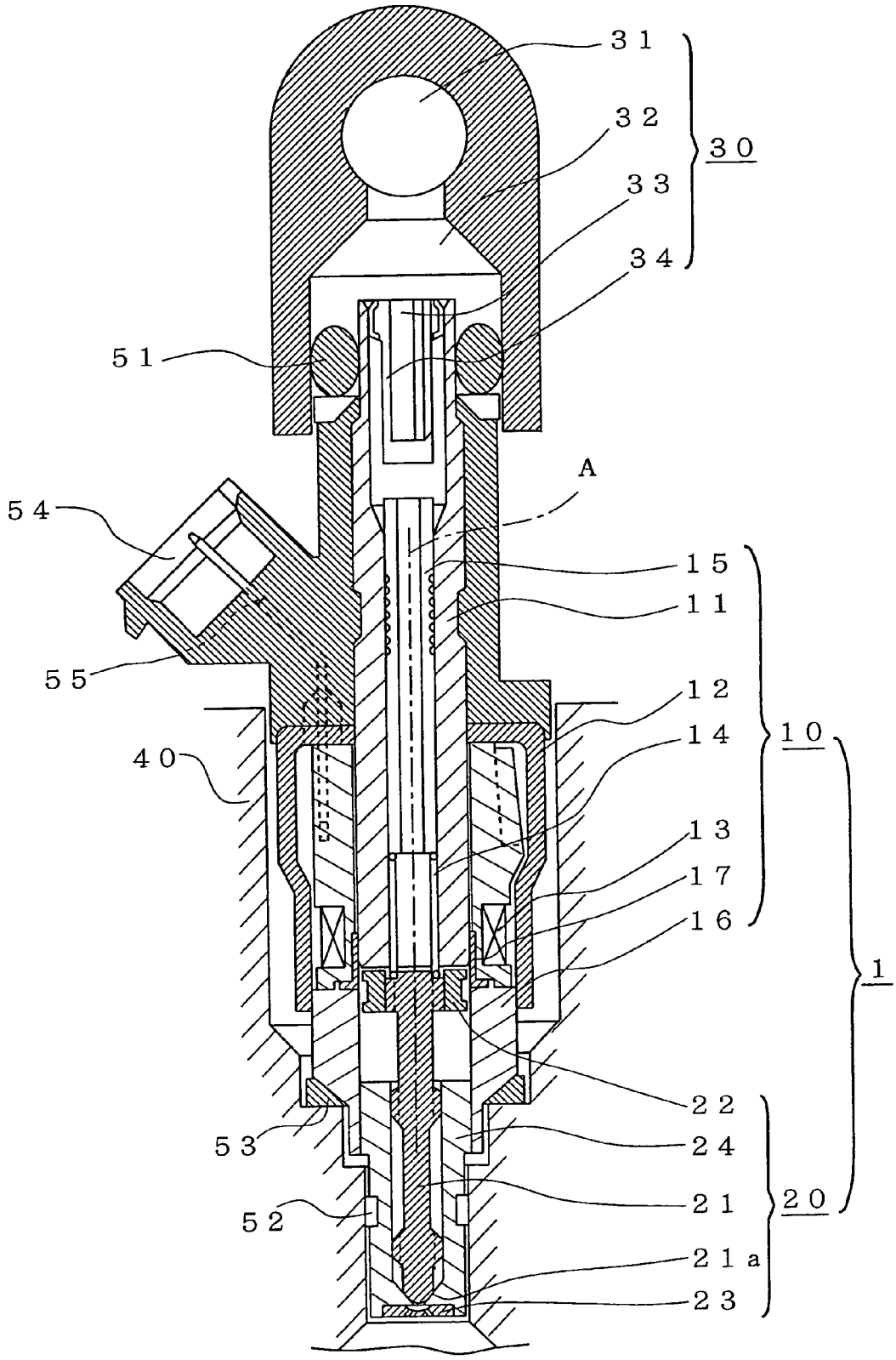
FIG. 1 is a longitudinal sectional view showing a construction of a whole fuel injection valve according to Embodiment 1 of the invention.
Figure 2:
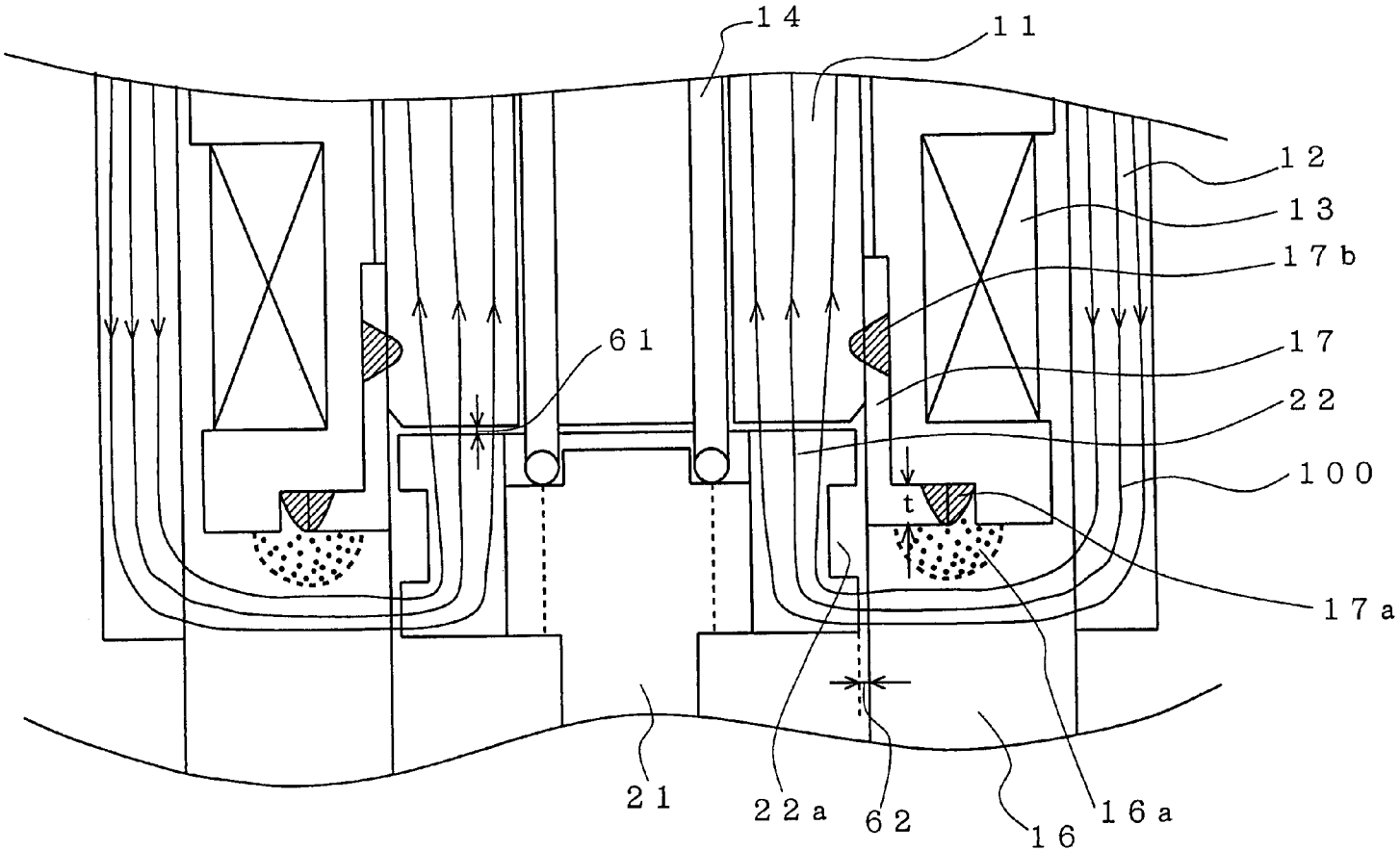
FIG. 2 is a partially enlarged view for explaining a construction of an essential part of the fuel injection valve according to Embodiment 1.

FIG. 1 is a vertical section showing construction of a whole fuel injection valve according to Embodiment 1, and FIG. 2 is a partial enlarged view for explaining a construction of an essential part (magnetic path portion) of the fuel injection valve according to Embodiment 1 shown in FIG. 1. Hatching that indicates a section is omitted in FIG. 2.

A fuel injection valve 1 according to this embodiment is comprised of a solenoid section 10 and a valve section 20 as shown in FIG. 1.

The solenoid apparatus 10 is comprised of a coil 13, a stationary iron core 11, a yoke 16, a housing 12, a sleeve 17 made of non-magnetic metal acting as a connecting member for connecting the stationary iron core 11 and the yoke 16, a compression spring 14 to give spring force that urges a valve element integrated with a moving iron core described later, a rod 15 for positioning and fixing the compression spring 14, and so on.

The valve apparatus 20 is comprised of a valve element 21, a valve main body 24 in which the valve element 21 is fixedly accommodated, a moving iron core 22 integrated with one end of the valve element 21, a valve seat 21*a* disposed at an end of the valve main body 24, a plate 23 having plural orifices, and so on.

Numeral 30 is a fuel supply pipe for supplying high-pressure (for example, not lower than 2 Mpa) fuel to the fuel injection valve 1, and numeral 31 is a fuel flow opening of the fuel supply pipe 30.

Because the engine for vehicle has plural cylinders, plural fuel injection valves are arranged in a direction crossing the drawing (i.e., direction perpendicular to the drawing) respectively conforming to the cylinders, and the longitudinal direction of the fuel supply pipe 30 is arranged in a direction crossing the drawing (i.e., direction perpendicular to the drawing). Numeral 33 is a mesh portion of a filter, and numeral 34 is a filter holding member.

The fuel injection valve 1 is disposed between the fuel supply pipe 30 and a cylinder head 40 of the engine through seal members 51 and 52, and mounted on a washer 53 by axial and downward load.

When a microcomputer of the engine sends an operation signal to a drive circuit (not shown) of the fuel injection valve 1, an electric current flows through the coil 13, and magnetic fluxes are generated in a magnetic loop comprised of the stationary iron core 11, moving iron core 22, yoke 16 and housing 12. As a result, the moving iron core 22 is attracted to the stationary iron core 11 by electromagnetic attraction stronger than the spring force of the compression spring 14.

As the moving iron core 22 is attracted to the stationary iron core 11, a valve seat 21*a* being an end of the valve element 21 integrated with the moving iron core 22 parts from a valve seat face of the valve main body 24. When a space is formed between the valve seat 21*a* and the valve seat face of the valve main body 24, high-pressure fuel is injected into the cylinders of the engine through the orifices of the plate 23.

When the microcomputer stops sending the operation signal from the drive circuit (not shown) of the fuel injection valve 1, there is no electric current flowing through the coil 13, and the attraction that has attracted the moving iron core 22 to the stationary iron core 11 vanishes.

As a result, the valve element 21 is urged to move toward the plate 23 by the spring force of the compression spring 14, and the valve seat 21*a* is pushed against the valve seat face of the valve main body 24, and thus the injection of fuel is lost.

Referring now to FIG. 2, numeral 61 is a thrust (axial) air gap. In this portion (i.e., in the thrust air gap 61), electromagnetic attraction works between the stationary iron core 11 and the moving iron core 22, and the stationary iron core 11 attracts the moving iron core 22.

Since the moving iron core 22 moves a certain distance in axial direction, it is required that the thrust air gap 61 is longer than a traveling distance of the moving iron core 22.

Numeral 62 is a radial air gap, and this air gap is secured between the moving iron core 22 and the yoke 16 in order to prevent the moving iron core 22 from touching the yoke 16 at the time of traveling the moving iron core 22 in the axial direction.

As described in the background of the invention, the sleeve 17 made of non-magnetic metal is comprised of a cylindrical part into which the stationary iron core 11 is fitted and a ring part constituting a ring-shaped protrusion formed on the outer circumference of an end on the yoke 16 side of the cylindrical part. As a result, the sleeve 17 is L-shaped in cross-sectional on a plane spreading through the axis A.

The ring part of the sleeve 17 is joined to the yoke 16 by laser welding with the ring part being in contact with an end face of the stationary iron core 11 side of the yoke 16, and the cylindrical part of the sleeve 17 is joined to the stationary iron core 11 fitted therein by laser welding.

Accordingly, the positional relation between the stationary iron core 11 and the yoke 16 is fixed through the sleeve 17.

In addition, numeral 17*a* indicates a portion where the ring part of the sleeve 17 and the yoke 16 are welded together, and numeral 17*b* indicates a portion where the cylindrical part of the sleeve 17 and the stationary iron core 11 are welded together. Laser welding joins these welded portions so that fuel may be sealed in.

Austenitic stainless steel being a low-permeability non-magnetic material is used as the sleeve 17 in order to prevent rust and minimize magnetic leakage between the stationary iron core 11 and the yoke 16 to a minimum.

The thickness t of the sleeve 17 is reduced to the minimum because it is necessary to reduce eddy current generated in the sleeve 17 as small as possible in order to provide rapid response of the magnetic fluxes generated in the magnetic loop comprised of the stationary iron core 11, moving iron core 22, yoke 16, and housing 12.

Melting temperature at the welded portion 17*a* where the sleeve 17 and the yoke 16 are welded together is higher than 1540° C., which is the melting point of iron, and temperature of the portion near the welded portion 17*a* of the yoke 16 (the portion surrounded by a broken-lined semi-circle in FIG. 2) also rises to approximately 1000° C. through heat conduction of metal.

It is this portion that acts as the magnetic characteristic change portion 16*a* where magnetic flux density becomes low and of which magnetic characteristics vary between one product and another.

In this embodiment, number of the magnetic fluxes passing through the magnetic characteristic change portion 16*a* (i.e., number of the magnetic lines of force 100) is reduced, whereby variation in magnetic characteristic in the magnetic characteristic change portion 16*a* of the yoke 16 gives less influence on the variation in number of the whole magnetic fluxes. Consequently, it is arranged such that the variation in electromagnetic attraction generated in the moving iron core 22 is suppressed.

For that purpose, a portion having strong magnetic resistance is formed by providing a recess (groove) 22*a* having a predetermined width and a predetermined depth on the outer circumference of the moving iron core 22 at a position facing the magnetic characteristic change portion 16*a*.

As a result, the magnetic fluxes passing thorough the moving iron core 22 detour and flow through underside of the recess 22*a* (i.e., on the side where the stationary iron core 11 does not exist), and this makes it possible to reduce number of the magnetic fluxes passing through the magnetic characteristic change portion 16*a* of the yoke 16 and avoid the influence of the variation in magnetic characteristic in this portion.

In addition, it is desirable that width of the recess (groove) 22*a* is larger than axial length of the magnetic characteristic change portion 16*a*.

It is further necessary to arrange the radial depth of the recession (groove) 22*a* so that decrease in electromagnetic force due to the reduction in number of the magnetic fluxes caused by the provision of the recess (groove) 22*a* on the outer circumference of the moving iron core 22 does not brings about any trouble when the fuel injection valve is put into practical use.

Figure 3:
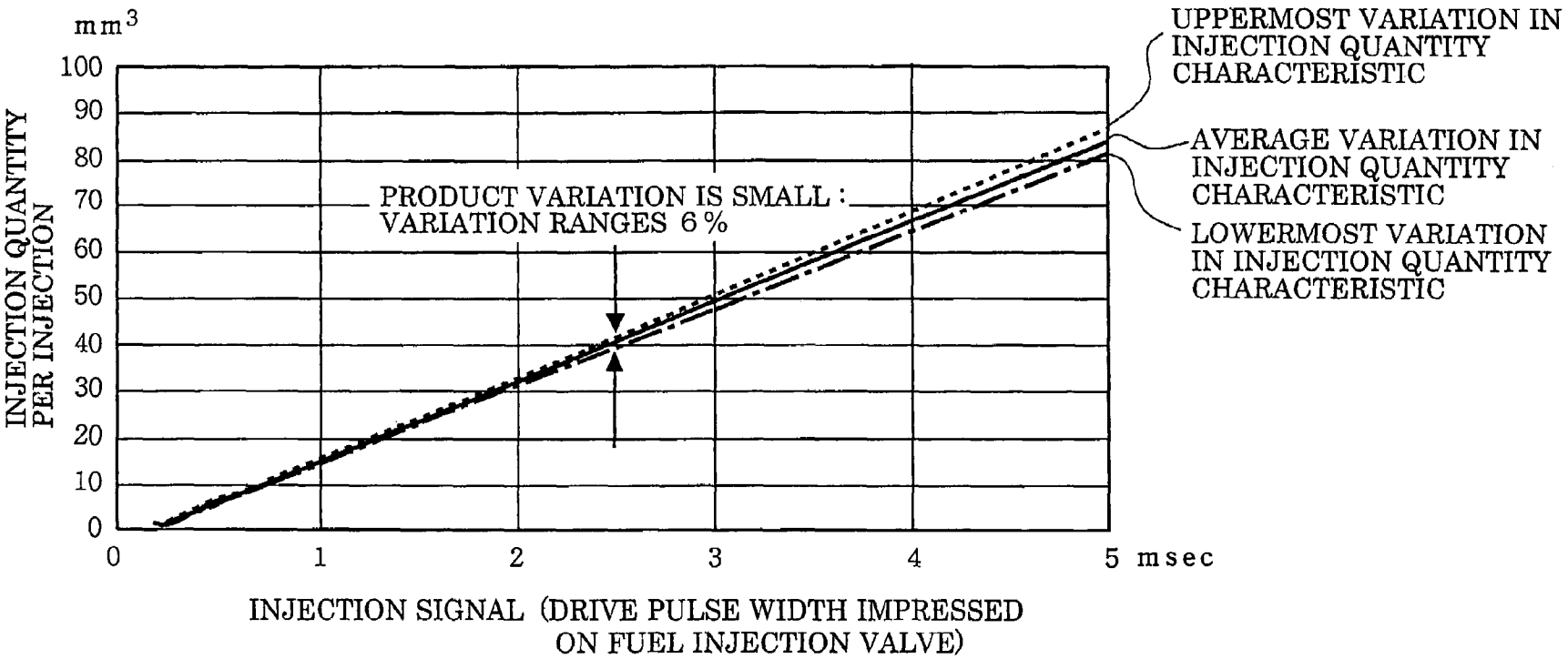
FIG. 3 is a graphic diagram showing injection quantity characteristics of the fuel injection valve according to Embodiment 1.

FIG. 3 is a graphic diagram showing injection quantity characteristics of the fuel injection valve according to this embodiment. In this diagram, the axis of abscissas indicates a drive pulse width (msec) of an injection signal impressed on the fuel injection valve, and the axis of ordinates indicates a fuel injection quantity ($mm^3$) per injection.

Figure 9:
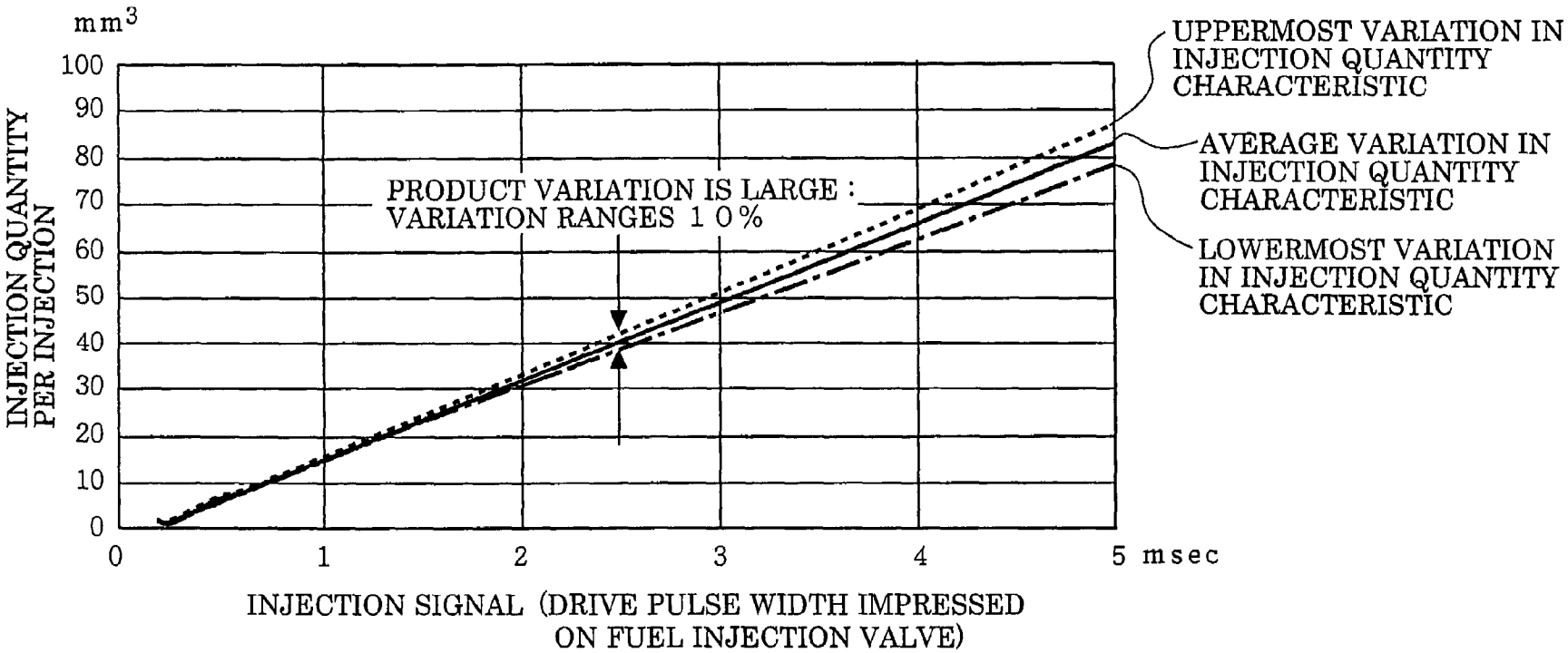
FIG. 9 is a graphic diagram showing variation in injection quantity characteristic of the fuel injection valve according to the prior art.

As compared with FIG. 9, while the variation in injection quantity characteristics of the conventional fuel injection valves ranges approximately 10% between the uppermost and lowermost injection quantities, the variation range is improved to the extent of only 6% in the fuel injection valve according to this embodiment.

According to Embodiment 1, the variation in injection quantity characteristic varying with each individual product of the mass-produced fuel injection valves is reduced, which makes it possible to produce fuel injection valves of stabilized and uniform quality.

As described above, the fuel injection valve according to the invention includes: a valve section 20 consisting of a cylindrical moving iron core 22 that reciprocates in axial direction in response to fuel injection signal, a valve element 21 integrated with the mentioned moving iron core 22 at one end and provided with a valve seat 21*a* at the other end, and a plate 23 having orifices that are opened and closed as the mentioned valve seat 21*a* comes in contact with the orifices and parts therefrom; and a solenoid section 10 consisting of a cylindrical stationary iron core 11 disposed facing the mentioned moving iron core 22 in axial direction, a cylindrical yoke 16 disposed on the outer circumference of the mentioned moving iron core 22, a non-magnetic metal sleeve 17 where the mentioned stationary iron core 11 and the mentioned yoke 16 are joined into one body by welding, a housing 12 forming a magnetic loop with the mentioned stationary iron core 11, moving iron core 22 and yoke 16, a coil 13 that is disposed on the outer circumference of the mentioned stationary iron core 11 and gives axial electromagnetic attraction to the mentioned moving iron core 22, and a compression spring 14 to urge spring force that moves the mentioned valve element 21 toward the mentioned plate 23.

In the mentioned fuel injection valve according to the invention, the mentioned moving iron core 22 is provided with a radial recess 22*a* of a predetermined width and a predetermined depth on the outer circumference thereof at a position facing a magnetic characteristic change portion 16*a* produced in the mentioned yoke 16 due to heat generated when the mentioned sleeve 17 and the mentioned yoke 16 are welded together.

As a result, the magnetic fluxes passing through the moving iron core 22 detour and flow through underside of the recess provided on the outer circumference of the moving iron core 22 (i.e., on the side where the stationary iron core is not disposed). This makes it possible to reduce number of magnetic fluxes passing through the magnetic characteristic change portion of the yoke 16 and prevent the influence of the variation in magnetic characteristic, and it is possible to suppress the variation in injection quantity characteristic of the products caused by the magnetic characteristic change portion 16*a* due to the heat generated at the time of welding the sleeve 17 and the yoke 16 together.

Embodiment 2

Figure 4:
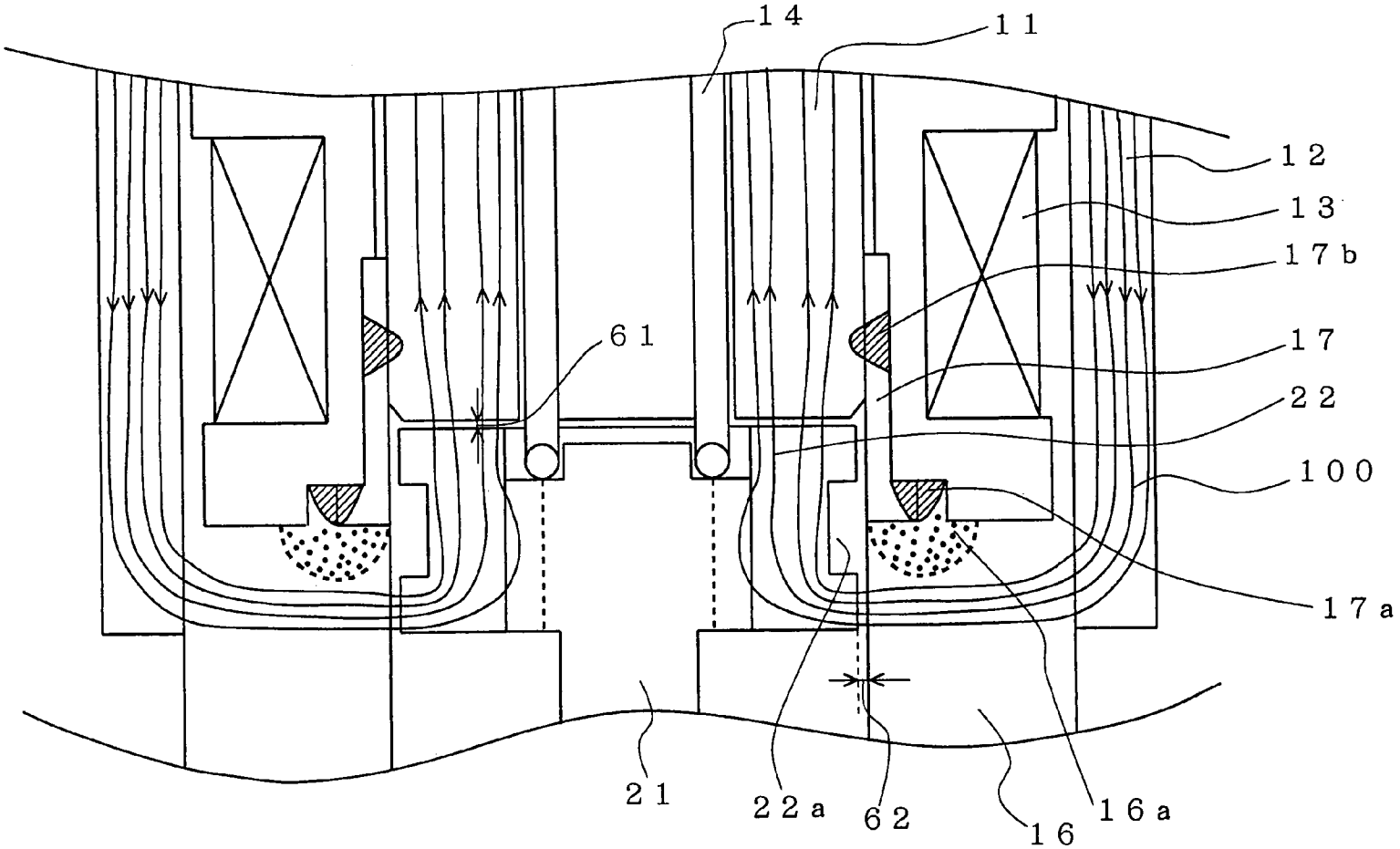
FIG. 4 is a partial enlarged view for explaining a construction of an essential part of a fuel injection valve according to Embodiment 2.

FIG. 4 is a partially enlarged view for explaining a construction of an essential part (magnetic path portion) of a fuel injection valve according to Embodiment 2. Hatching that indicates a section is omitted in FIG. 4.

In the fuel injection valve according to the foregoing Embodiment 1, since the moving iron core 22 is provided with a recess 22*a* having a predetermined width and a predetermined depth on the outer circumference thereof and radial thickness of the moving iron core 22 is reduced, there is a disadvantage that magnetic fluxes are blocked and electromagnetic force decreases in this portion.

This disadvantage is overcome in the fuel injection valve according to Embodiment 2 by employing a magnetic material as the valve element 21 so that the magnetic lines of force 100 also pass through the upper part of the valve element 21.

Thus, the upper part of the valve element 21 and the moving iron core 22 act as parallel magnetic paths, which makes it possible to prevent decrease in number of magnetic fluxes due to provision of the recess 22*a* on the outer circumference of the moving iron core 22.

In addition, the valve seat 21*a* at the lower part of the valve main body 24 comes in contact with the plate 23 provided with the orifices, and therefore martensitic stainless steel being an abrasion resistant magnetic material is employed as the valve seat 21*a*.

Figure 5:
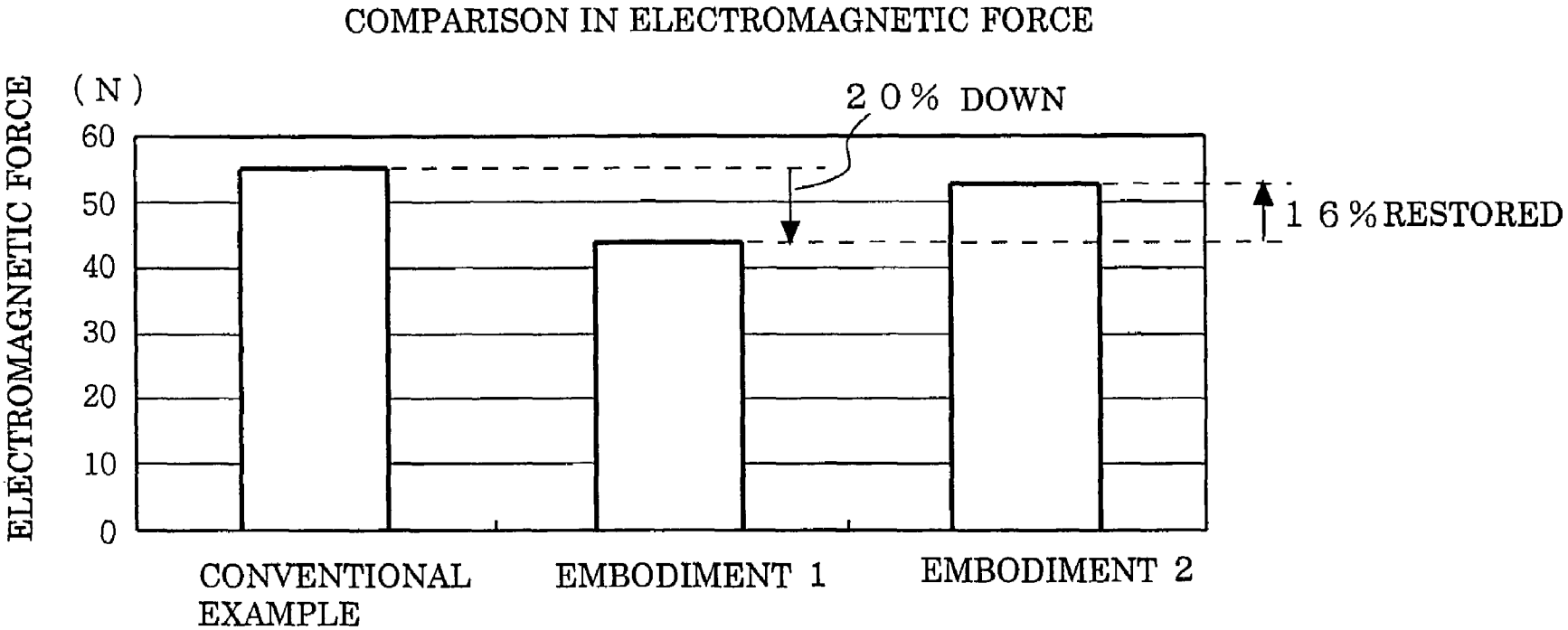
FIG. 5 is a graphic diagram for explaining advantages of the fuel injection valve according to Embodiment 2.
Figure 6:
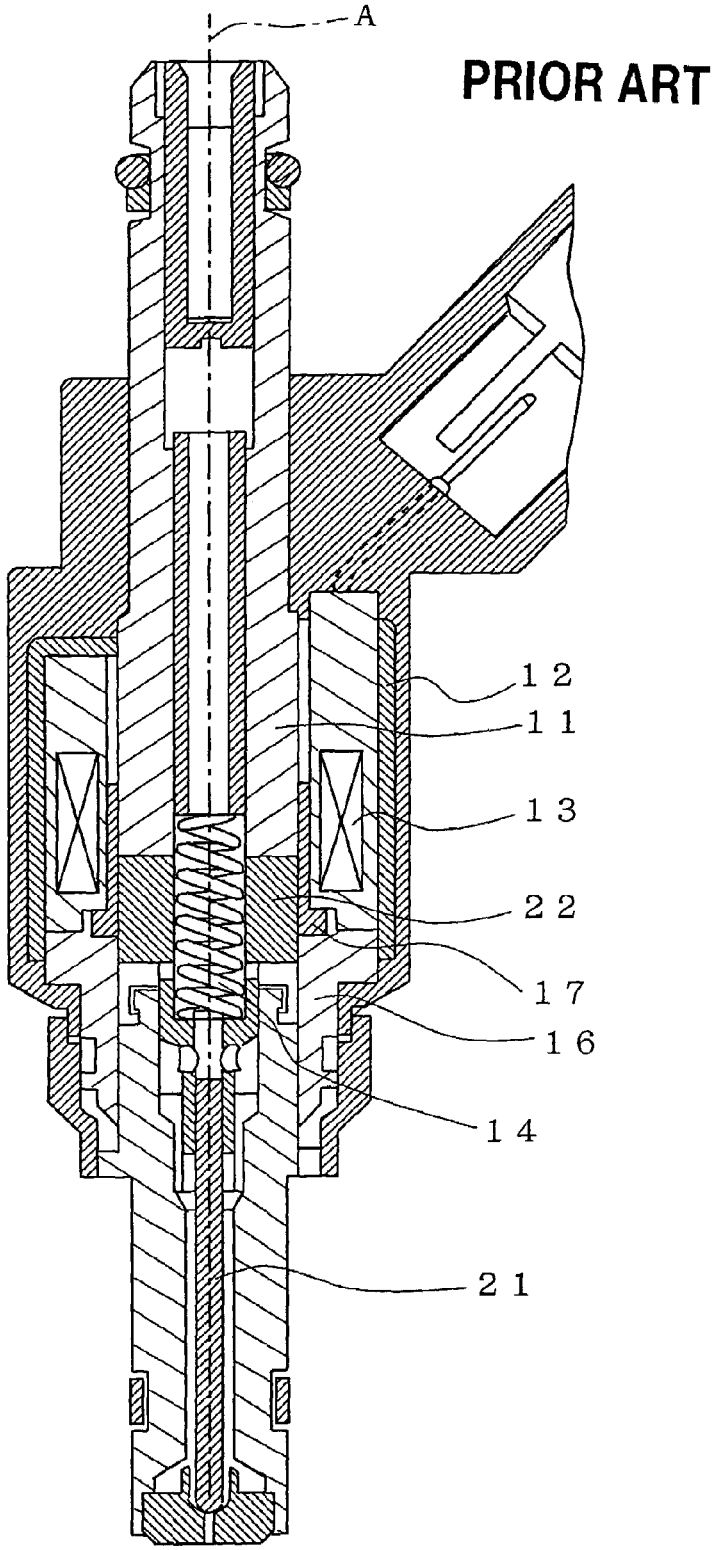
FIG. 6 is a longitudinal sectional view showing a construction of a whole fuel injection valve according to the prior art.
Figure 7:
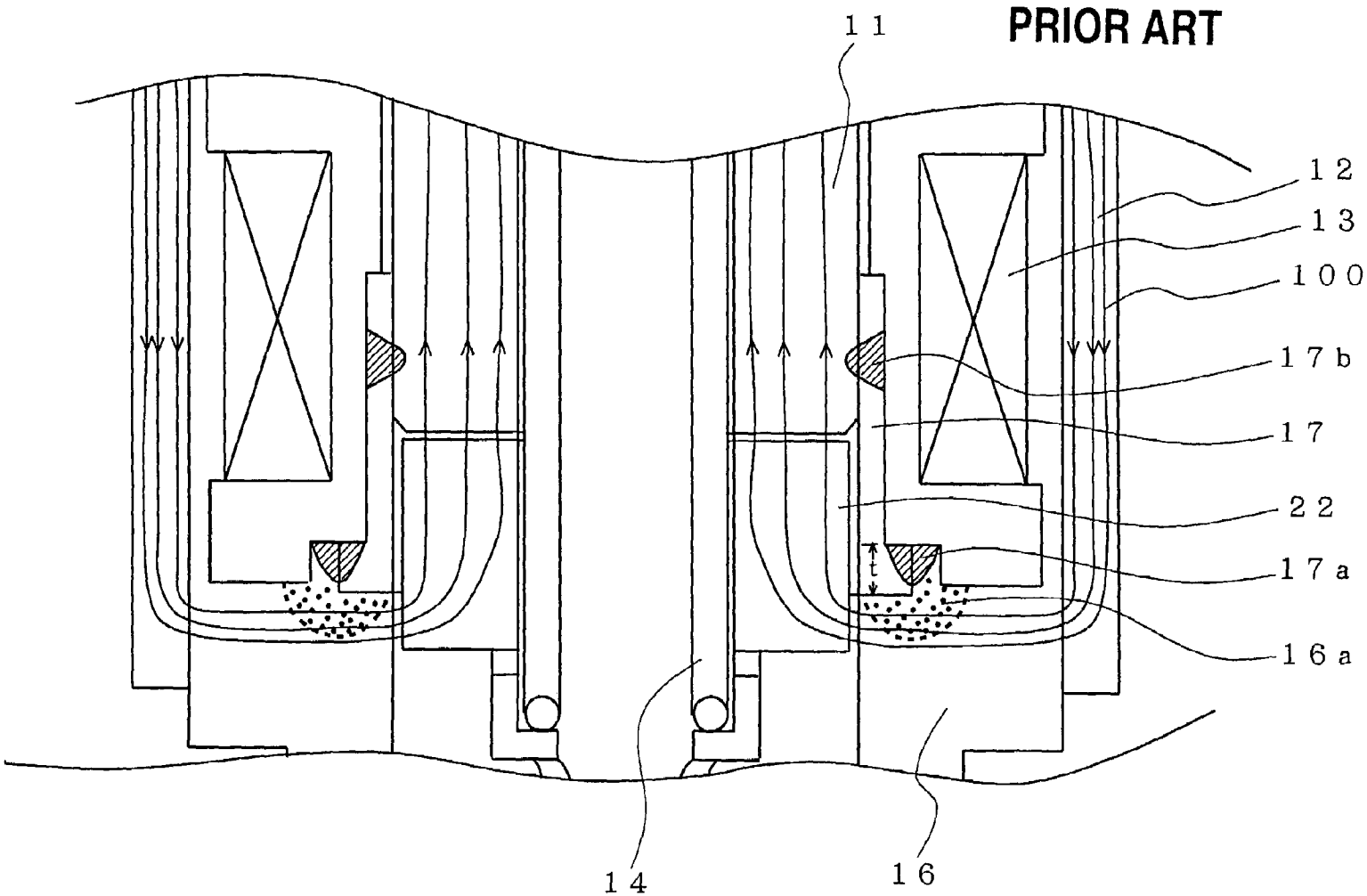
FIG. 7 is a partial enlarged view for explaining a construction of an essential part of the fuel injection valve according to the prior art.
Figure 8:
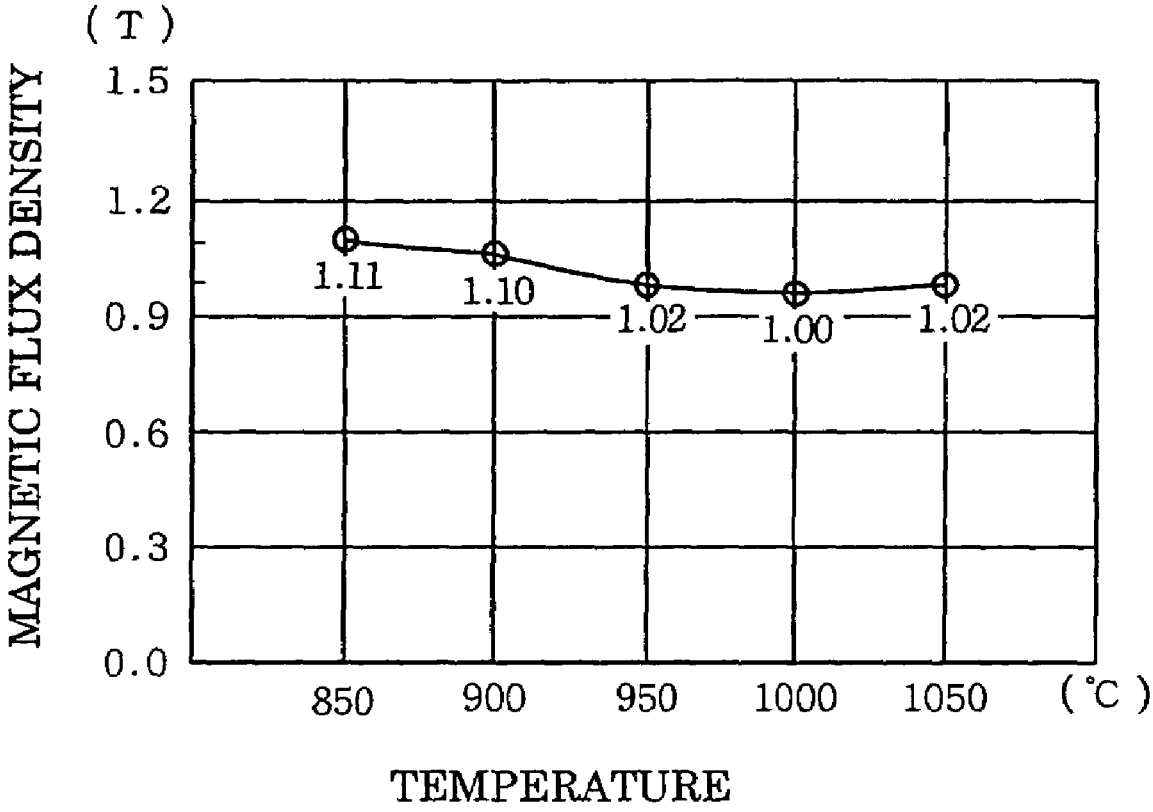
FIG. 8 is a graphic diagram showing the relation between magnetic flux density and temperature of electromagnetic stainless steel used in a yoke.

FIG. 5 is a graphic diagram for explaining the advantages of the fuel injection valve according to Embodiment 2.

In the fuel injection valve according to the foregoing Embodiment 1, variation in injection quantity characteristic of the mass-produced fuel injection valves is reduced by providing a recess 22*a* on the outer circumference of the moving iron core 22 and preventing the magnetic fluxes from passing through the magnetic characteristic change portion 16*a* of the yoke 16.

However, as shown in FIG. 5, electromagnetic force of the solenoid section 10 is lower than that in the conventional valve by approximately 20% due to reduction in number of magnetic fluxes passing through the magnetic path.

On the other hand, in the fuel injection valve according to Embodiment 2, the valve element 21 is made of a magnetic material, whereby upper part of the valve element 21 and the moving iron core 22 act as parallel magnetic paths. Therefore, the decrease in number of magnetic fluxes is prevented. As a result, as shown in FIG. 5, the solenoid section 10 exhibits restoration in electromagnetic force by approximately 16% as compared with that of the foregoing Embodiment 1.

As described above, in the fuel injection valve according to Embodiment 2, the variation in injection quantity characteristic of the mass-produced fuel injection valves is reduced by providing the recess 22*a* on the outer circumference of the moving iron core 22, thereby preventing the magnetic fluxes from passing through the magnetic characteristic change portion 16*a* of the yoke 16. Furthermore, employing a magnetic material as the valve element 21 and utilizing the upper part of the valve element 21 and the moving iron core 22 as parallel magnetic paths prevent the decrease in number of magnetic fluxes. This results in quite a small decrease (approximately 4%) in electromagnetic force of the solenoid section 10.

Consequently, in Embodiment 2, it is possible to achieve a fuel injection valve in which variation in injection quantity characteristic is small and decrease in electromagnetic force of the solenoid section is very small.

While the presently preferred embodiments of the present invention have been shown and described, it is to be understood that these disclosures are for the purpose of illustration and that various changes and modifications may be made without departing from the scope of the invention as set forth in the appended claims.

What is claimed is:

1. A fuel injection valve comprising:

a valve section comprising:

a cylindrical moving iron core that reciprocates in an axial direction in response to a fuel injection signal;

a valve element integrated with said moving iron core at one end and provided with a valve seat at the other end;

a valve main body in which the valve element is accommodated; and a plate provided with orifices that are opened and closed as said valve seat comes in contact with and moves away from a valve seat face of the valve main body; and a solenoid section comprising:

a cylindrical stationary iron core disposed facing said moving iron core in said axial direction;

a cylindrical yoke disposed on an outer circumference of said moving iron core;

a non-magnetic metal sleeve that joins said stationary iron core and said yoke into one body by welding;

a housing forming a magnetic loop with said stationary iron core, moving iron core and yoke;

a coil that is disposed on the outer circumference of said stationary iron core and gives axial electromagnetic attraction to said moving iron core; and a compression spring urging said valve element toward said plate;

wherein said moving iron core is provided with a radial recess on the outer circumference of the moving iron core at a position facing a magnetic characteristic change portion produced in said yoke due to heat generated when said sleeve and said yoke are welded together, wherein said yoke and said sleeve do not protrude into said radial recess.

2. The fuel injection valve according to claim 1, wherein said valve element of which one end is integrated with said moving iron core is made of a magnetic material.

* * * * *